US008763814B2

(12) United States Patent
Robertson et al.

(10) Patent No.: US 8,763,814 B2
(45) Date of Patent: Jul. 1, 2014

(54) SIFTING SCREEN

(75) Inventors: Graham Robertson, Edinburgh (GB); Claire McLean, Lothian (GB); Andrew Ralph, Lothian (GB)

(73) Assignee: United Wire Limited, Edinburgh (GB)

( * ) Notice: Subject to any disclaimer, the term of this patent is extended or adjusted under 35 U.S.C. 154(b) by 0 days.

(21) Appl. No.: 12/995,485

(22) PCT Filed: Jul. 8, 2009

(86) PCT No.: PCT/GB2009/050803
§ 371 (c)(1), (2), (4) Date: Mar. 7, 2011

(87) PCT Pub. No.: WO2010/004326
PCT Pub. Date: Jan. 14, 2010

(65) Prior Publication Data

US 2011/0155653 A1 Jun. 30, 2011

(30) Foreign Application Priority Data

Jul. 10, 2008 (GB) ..... 0812629.4

(51) Int. Cl.
*B07B 1/46* (2006.01)

(52) U.S. Cl.
USPC ..... 209/393; 209/405

(58) Field of Classification Search
USPC ..... 209/393, 394, 395, 404, 405; 460/101, 460/102
See application file for complete search history.

(56) References Cited

U.S. PATENT DOCUMENTS

| | | | | |
|---|---|---|---|---|
| 675,745 | A | 6/1901 | Lippy | |
| 1,939,314 | A * | 12/1933 | Neifert et al. | 209/397 |
| 2,172,551 | A * | 9/1939 | Symons | 209/395 |
| 2,190,262 | A * | 2/1940 | Geist | 460/91 |
| 2,192,278 | A * | 3/1940 | Symons | 209/275 |
| 2,201,083 | A | 5/1940 | Evenson | |
| 2,428,294 | A | 9/1947 | Ross | |
| 3,390,771 | A * | 7/1968 | Wehner | 209/365.1 |
| 4,548,213 | A | 10/1985 | Phillips | |
| 7,810,649 | B2 * | 10/2010 | Robertson | 209/401 |
| 7,819,254 | B2 | 10/2010 | Robertson | |
| 7,819,255 | B2 * | 10/2010 | Cady | 209/405 |
| 2003/0130019 | A1 | 7/2003 | Mammen | |
| 2010/0270215 | A1 * | 10/2010 | Robertson et al. | 209/363 |

FOREIGN PATENT DOCUMENTS

| | | | |
|---|---|---|---|
| CN | 2393645 | Y | 8/2000 |
| DE | 1221581 | | 7/1966 |
| DE | 20307614 | U1 | 8/2003 |
| GB | 291530 | | 6/1928 |
| JP | 10225661 | A | 8/1998 |
| SU | 973185 | A1 | 11/1982 |

OTHER PUBLICATIONS

Written Opinion in PCT/GB2009/050803 dated Oct. 6, 2009.
UK Search Report in GB0812629.4 dated Nov. 10, 2008.

* cited by examiner

*Primary Examiner* — Joseph C Rodriguez
(74) *Attorney, Agent, or Firm* — Patents + TMS, P.C.

(57) ABSTRACT

The invention relates to a screen frame adapted for use in a shaker to separate solids from a liquid/solid mixture and to which woven wire mesh is to be attached, comprising an outer perimeter and a plurality of ribs extending between opposing regions of the perimeter, the ribs defining an upper horizontal face to which a screen is to be attached, wherein at least one rib extends downwardly from the upper face at an angle off set to vertical, and to a shaker comprising at least one such screen frame.

11 Claims, 3 Drawing Sheets

SIFTING SCREEN

FIELD OF THE INVENTION

The invention relates to sifting screens which in use are fitted to a shaker to separate solids from liquids and in particular to separate solids from liquid drilling muds brought up from down-hole when drilling for oil or gas.

BACKGROUND TO THE INVENTION

Efficiently separating solids from liquids is a widespread technical problem. One of the most practical and robust methods of achieving this remains the use of a sieve, or screen, to sift the solids from the mixture of liquid and solid.

When drilling for oil and/or gas, synthetic drilling fluids, or muds, are used. As these muds are relatively expensive to manufacture, once used they are typically recovered in a process including sifting rock, shale and other debris from the mud. This involves the use of a so-called shaker which has fitted, one or more sifting screens, made up of a screen frame with one or more sheets of woven wire mesh, or screen, stretched over and secured to it. In use, the shaker vibrates the sifting screen or screens, to aid the sifting process.

In order for such sifting screens to be able to withstand the rigours of such a process, they must have a certain rigidity and be very hard-wearing. This has resulted in a design of sifting screen having a screen frame which has a plurality of reinforcing "ribs". A common design of screen frame is rectangular comprising an outer rectangular perimeter with each side connected to its opposing side by a plurality of ribs together forming an upper face and a lower face. Such a design results in a plurality of rectangular openings. Typically the screen is attached not only to the rectangular perimeter but also to the ribs, to provide better adhesion of the screen to the frame and prolonging its lifetime. The upper face and lower face are horizontal and parallel to each other, the ribs extending downwardly between the faces orthogonally to the faces (i.e. vertically).

In view of the fact that sifting screens are man-handled into position, such screen frames have for some time been made from plastics material to reduce weight. A common design of plastics screen frame is reinforced by including a metal wire structure, embedded within the plastics rectangular perimeter and rib arrangement.

However, despite the measures taken to provide sufficient rigidity, the present inventors have found that vibratory motion typically involved in shakers is not successfully transmitted by the screen frame to the attached screen. Excessive motion of screens has been observed, known as "whipping", which can result in erratic solids conveyancing and premature screen failure.

SUMMARY OF THE INVENTION

The present invention relates to a screen frame adapted for use in a shaker to separate solids from a liquid/solid mixture and to which woven wire mesh is to be attached, comprising an outer perimeter and a plurality of ribs extending between opposing regions of the perimeter, the ribs defining an upper horizontal face to which a screen is to be attached, wherein at least one rib extends downwardly from the upper face at an angle offset to vertical.

When the frame is fitted in a shaker of a particular type, and fitted in the correct orientation, it is clamped on at least two sides of the perimeter. In use, the frame is caused to vibrate at an angle to the upper face, the angled nature of the ribs increasing the rigidity of the frame without necessarily increasing weight because of the angled nature of the frame. It is preferably adapted to be fitted to the shaker in a particular orientation to prevent it being fitted incorrectly.

Preferably the frame has a perimeter consisting of four straight sides, e.g. rectangular, the ribs extending between both pairs of opposing regions, forming a plurality of rectangular openings and the upper and lower faces being parallel to each other.

In a preferred embodiment, the screen frame has a wire mesh attached to it, comprising a network of orthogonal wires with a spacing much less than between the plurality of ribs. In use, the frame according to the invention is forced to vibrate in an upwards and downwards sense (i.e. orthogonal to the upper face) by the shaker it is fitted in. The liquid/solid mixture to be separated is then passed across the at least one frame according to the invention, generally from one side of the rectangular perimeter to the opposing side. This vertical vibrating motion is usually also accompanied by lateral motion in the direction of passage of the liquid/solid mixture. This lateral motion may be in phase with the vertical motion to produce a diagonal motion of the frame, moving in the same general direction as the direction of the passing liquid/solid mixture as the frame moves upwards. Alternatively, the lateral motion may be out-of-phase with the vertical motion, e.g. to provide an elliptical motion of the frame. Consequently, the frame moves in the opposite general direction of the passing liquid/solid mixture as the frame moves downwards. This motion has the effect of conveying the solids across the surface of the frame.

The screen frame is arranged such that the at least one angled rib is substantially transverse to the direction of lateral motion, and is angled away from vertical so as to be more closely aligned with the direction of diagonal motion.

The present inventors have observed that the rigidity of transverse ribs is dependant upon the inertia of the ribs in the direction of diagonal motion. By angling at least one transverse rib so that it is more closely aligned with the diagonal motion provides increased inertia, and therefore rigidity, without an increase in weight.

The frame is preferably arranged such that the at least one angled rib extends between regions of the perimeter which are to be clamped in place in the shaker. If the frame is rectangular then preferably it is clamped along its long sides, for increased rigidity. It is also possible that all four sides of the rectangular frame are clamped.

Most commonly the lateral vibrating motion of the frame in use is parallel with the clamped sides of the rectangular frame, so that the solids flow is also parallel to the clamped sides. However it is also possible that the lateral vibrating motion in use is orthogonal to the clamped sides.

The perimeter is preferably made of plastics, e.g. GRP plastics and has a thickness, extending vertically from 3 to 8 cm. The ribs are preferably made from the same material as the perimeter for simplicity, and preferably also have substantially the same thickness, providing a well-defined upper face and, typically also a lower face, to the frame.

When rectangular the perimeter may comprise long sides having a length of, for example, from 40 to 100 cm and short sides having a length of, for example, from 20 to 70 cm, and will have dimensions chosen so as to fit snugly into the particular shaker it is adapted for use in.

Having more angled ribs has been found to give increased rigidity. Preferably therefore the screen comprises a plurality of angled ribs and, in a preferred embodiment, substantially all transverse ribs are angled ribs.

Ideally, the ribs will be angled so that they are aligned with the direction of diagonal motion. Therefore, preferably the at least one angled rib subtends an angle of less than 30° to the direction of diagonal motion, preferably less than 20°, more preferably less than 10° and ideally 0°.

Most commonly the diagonal motion will be at approximately 45° to the plane of the upper face. Therefore preferably the at least one angled rib is angled away from vertical (being normal to the upper and lower faces) by from 15° to 75° preferably from 25° to 65°, more preferably from 35° to 55°, and ideally 45°.

To further increase its rigidity, the screen frame may also comprise at least one metal rib extending between opposing, clamped regions of the perimeter.

Having more metal ribs has been found to give increased rigidity, however at increasing weight.

Preferably therefore, the frame comprises from one to five metal ribs, preferably from two to four metal ribs. Three metal ribs have been found to provide a good optimum rigidity without excessive weight increase.

The ends of the metal ribs ideally are located at or within the perimeter material to give optimal rigidity. However, the ends could fall short of the perimeter by a small distance, provided that another material was employed to connect the metal ribs to the perimeter. Generally the at least one metal rib will traverse at least 90% of the distance between the opposing regions it extends between.

The at least one metal rib also extends from the upper face to the lower face. Preferably the at least one metal rib extends from 50% to 100% of the distance from the upper face to the lower face, more preferably from 60% to 90%.

The at least one metal rib is typically straight with a constant rectangular cross-section. The length of the sides of the rectangular cross-section extending between the upper and lower faces is preferably much greater than the short sides of the rectangular cross-section. Having short sides in cross-section, or "thin" ribs, reduces weight without significant reduction in rigidity. Typically the at least one metal ribs are less than 1.0 cm in thickness.

Thus, a typical dimension for a metal rib for use in the invention is 50 cm×5 cm×0.5 cm.

The at least one metal rib may be used as it is or, preferably, may be encased in surrounding plastics material. Preferably it is encased in the same plastics material as forms the plastics ribs and so that the dimensions of the encased metal rib are substantially, or exactly, the same as those of the plastics ribs.

Preferably the at least one metal rib has a plurality of holes. This not only reduces weight without significantly affecting rigidity but also aids the passage of molten plastics when encasing the metal ribs, if this is desired. The at least one metal rib may be made out of any suitable metal, e.g. steel.

Preferably, the ribs are made of plastics and some or all of the plastics ribs are reinforced with internal wires. Preferably the wires extend fully inside the ribs, terminating at or in the perimeter. The ends of the wires may be connected by a further wire running through the perimeter material, thus forming a wire mesh structure, encased in plastics ribs and perimeter material.

In a further refinement, the wire mesh may have a second layer of wire mesh structure so that two wires run through at least some of the plastics ribs, one above the other. The second layer, if present, is above the first layer and is typically rigidly connected to it. Lengths of wire bent to form spacers and adapted to fit between upper and lower wire structures may be welded or otherwise joined to the upper and lower wires, so as to extend therebetween and maintain the desired separation of the two layers of wires. The spacers are preferably wholly contained within the plastics material forming the ribs.

In a preferred embodiment, the first and second wire mesh structures are each an orthogonal array of wires arranged to be horizontally displaced with respect to each other, such that when encased in plastics, reinforced ribs extend between the perimeter and extend downwardly from the upper face at an angle offset to vertical.

In another aspect, the invention relates to a shaker comprising at least one screen frame according to the invention clamped in position.

The invention also relates to a process of separating solids from a liquid/solid mixture comprising employing at least one screen frame according to the invention clamped into position in a shaker.

The invention will now be described, by way of example, with reference to the following figures, in which.

DESCRIPTION

Figure 1:
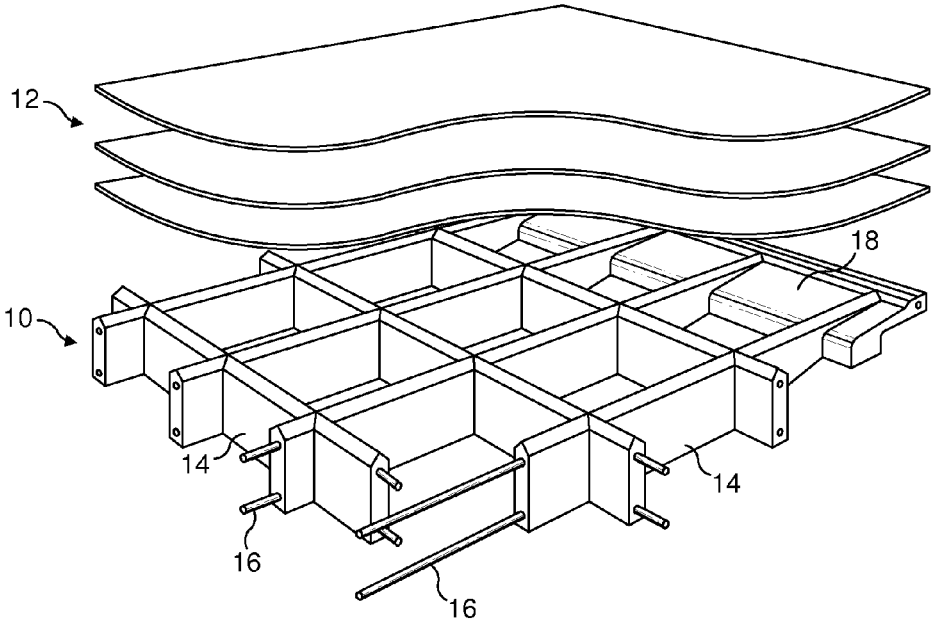
FIG. 1 is an exploded perspective view of a part of a known screen.

FIG. 1 shows a known screen frame 10 showing an exploded view of three layers of woven wire mesh 12. The frame 10 comprises an orthogonal array of plastics ribs 14 reinforced with two layers of wires 16. The ribs are integrally formed with part of a rectangular perimeter 18.

Figure 2:
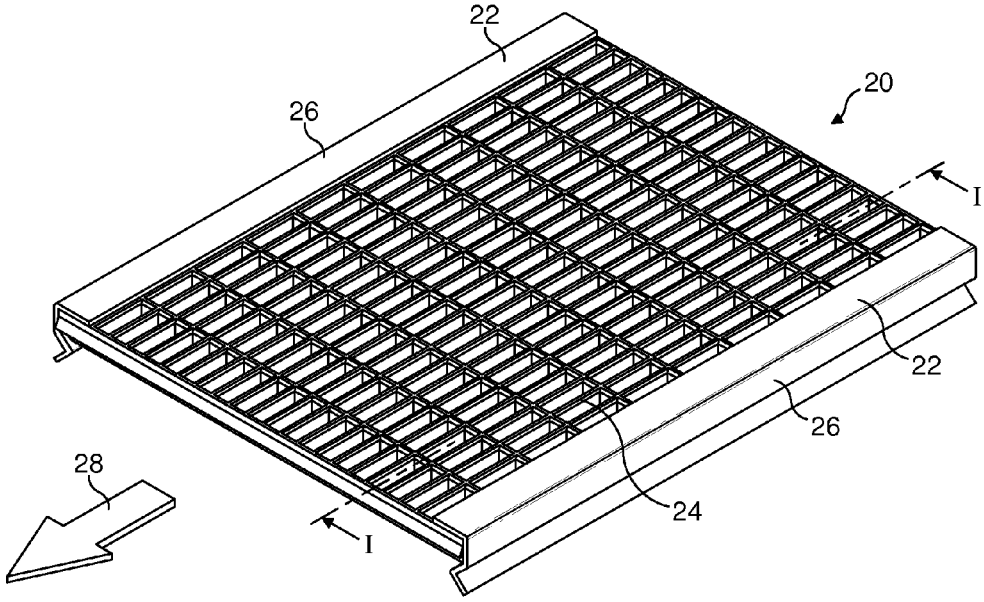
FIG. 2 is a perspective view of a known screen frame clamped in position.

FIG. 2 shows a known screen frame 20 comprising a plastics perimeter 22 and an orthogonal array of plastics ribs 24. The perimeter 22 is clamped along its long ends by clamps 26. The ribs together form a well-defined horizontal upper face and horizontal lower face (not shown). The ribs extend downwardly from the upper face to the lower face in a vertical direction.

In use, the clamps 26 vibrate along the direction indicated by the arrow 28 and with an in-phase motion upwards and downwards (i.e. orthogonal to the upper and lower faces), so that the frame vibrates in a direction at 45° to the direction of arrow 28, or with an out-of-phase lateral motion providing elliptical motion with its long axis at 45° in the direction of arrow 28.

Figure 3:
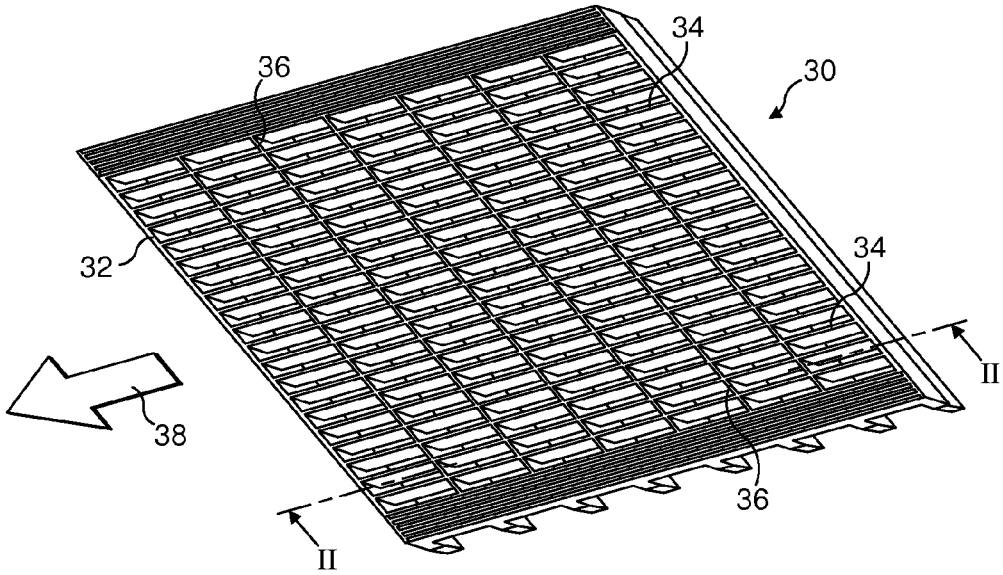
FIG. 3 is a perspective view of a screen frame according to the invention.

FIG. 3 shows a screen frame 30 according to the invention comprising a perimeter 32 and an orthogonal array of plastics ribs consisting of longitudinal ribs 34 and transverse ribs 36. The ribs together form an upper horizontal face, to which a screen is to be attached. Longitudinal ribs 34 extend downwardly in a vertical direction whereas transverse ribs 36 extend downwardly at an angle of about 45° to vertical.

In use clamps (not shown) vibrate along the direction indicated by the arrow 38 and with an in-phase motion upwards and downwards (i.e. orthogonal to the upper and lower faces), so that the frame vibrates in a direction at 45° to the direction of arrow 38, or with an out-of-phase lateral motion providing elliptical motion with its long axis at 45° to the direction of arrow 38. Thus, the transverse ribs 36 are in line with the direction of motion of the frame 30.

Figure 4:
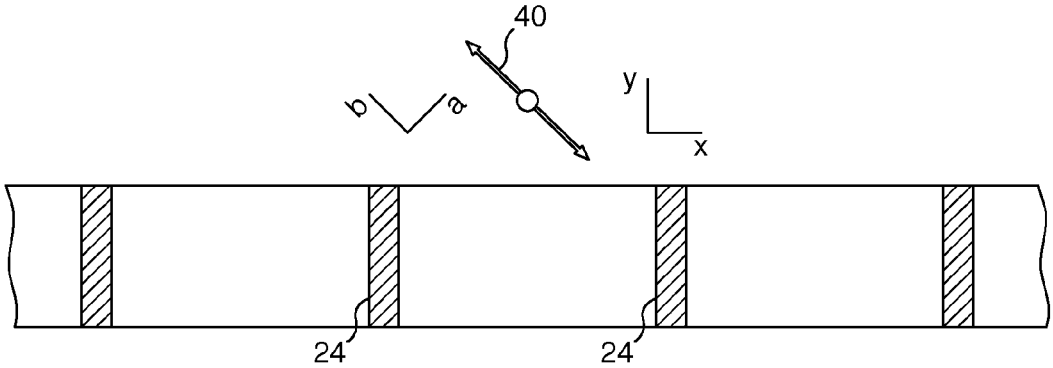
FIG. 4 is a schematic part sectional view showing transverse ribs of a known screen frame in section.

FIG. 4 shows a schematic part sectional view from direction I-I in FIG. 2. The direction of motion of the screen frame in use is indicated by the double-headed arrow 40. If the height of the rib, from upper face to lower face, is 1.0 units, then the length of the rib in the direction of the direction of motion is $1/\sqrt{2}$, or about 0.7. In other words only 70% of their height contributes to the rigidity of the screen.

Figure 5:
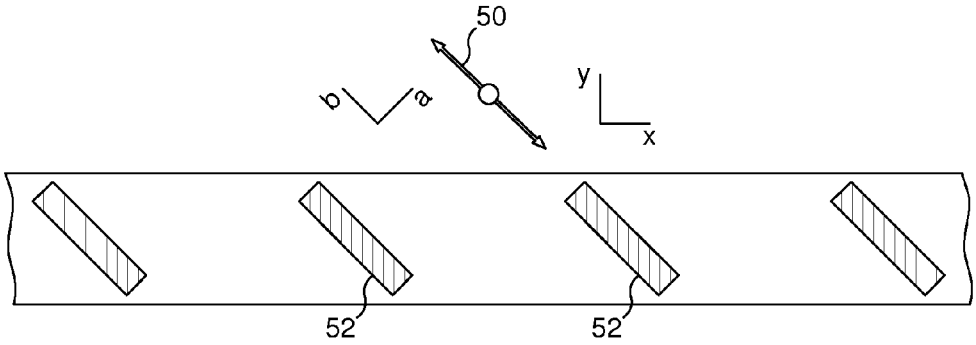
FIG. 5 is a schematic part sectional view showing the angled transverse ribs of a screen frame according to the invention.

FIG. 5 shows a schematic part sectional view of a screen frame similar to that shown in FIG. 2, but wherein the transverse ribs 52 are aligned with the direction of motion 50. Accordingly, 100% of the length of the ribs contributes to the rigidity of the screen, giving a significant improvement in rigidity over the screen frame shown in FIG. 2 with no increase in weight.

Figure 6:
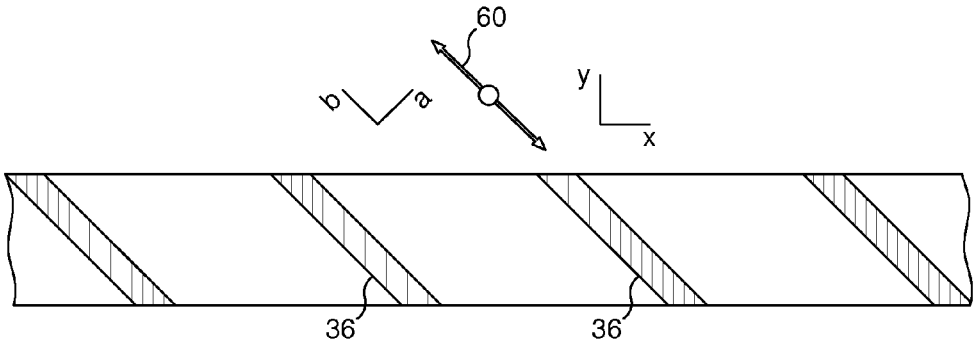
FIG. 6 is a further schematic part sectional view showing the angled transverse ribs of a screen frame according to the invention.

FIG. 6 shows schematic part sectional view from direction II-II in FIG. 3. As in FIG. 5, the transverse ribs 52 are aligned with the direction of motion 50. However, the ribs are longer than those in FIG. 5, extending fully between the upper and lower regions of the perimeter (not shown). If the length of the ribs 42 in FIG. 5 are 1.0, then the length of ribs 52 in FIG. 6 are $\sqrt{2}$, or about 1.4, 100% of which contributes to the rigidity of the frame. The angled ribs 52 according to the invention are therefore twice as rigid (1.4 compared to 0.7) as those in the prior art, as shown in FIG. 4.

The invention claimed is:

1. A shaker comprising:

a screen frame having an outer perimeter wherein the outer perimeter has opposing regions and a plurality of ribs extending between the opposing regions of the perimeter, the plurality of ribs defining an upper horizontal face, wherein at least one rib has a first side and a second side extending downwardly from the upper horizontal face at an angle offset to vertical wherein the first side is parallel to the second side, and wherein the at least one angled rib is integrally formed with the screen frame and extends between the opposing regions of the perimeter, wherein the opposing regions are clamped in place in the shaker.

2. The shaker according to claim 1, wherein the screen frame has a rectangular perimeter, the ribs extending between both pairs of opposing regions, forming a plurality of rectangular openings.

3. The shaker according to claim 1, further comprising a plurality of angled ribs substantially parallel to each other extending downwardly from the upper horizontal face at an angle offset to vertical wherein each of the angled ribs is integrally formed with the screen frame and further wherein each of the angled ribs has a first side and a second side wherein the first side is parallel to the second side.

4. The shaker according to claim 3 wherein all of the ribs in a particular orientation are angled ribs integrally formed with the screen frame.

5. The shaker according to claim 1 wherein the screen frame is adapted to be fitted to the shaker in a particular orientation so that in use the at least one angled rib is transverse to the lateral direction of vibration and more closely aligned to the actual direction of vibration than would a notional rib which extends vertically from the upper face.

6. The shaker according to claim 5, wherein the at least one angled rib subtends an angle of less than 30° to the direction of vibration.

7. The shaker according to claim 6, wherein the at least one angled rib subtends an angle of less than 20° to the direction of vibration.

8. The shaker according to claim 1, wherein the at least one angled rib is angled between from 15° to 75° from vertical.

9. The shaker according to claim 8, wherein the at least one angled rib is angled between from 25° to 65° from vertical.

10. A shaker comprising:

a screen frame having an outer perimeter wherein the outer perimeter has opposing regions and a plurality of ribs extending between the opposing regions of the perimeter plurality of ribs, the plurality of ribs defining an upper horizontal face on the screen frame wherein each of the plurality of ribs has a first side and a second side wherein the first side is parallel to the second side, wherein a portion of the plurality of ribs extends downwardly from the upper horizontal face at an angle offset to vertical, and wherein the plurality of angled ribs extends between the opposing regions of the perimeter and further wherein each of the angled ribs is integrally formed with the screen frame, and wherein the opposing regions of the perimeter are clamped in place.

11. A shaker having a direction of vibration, the shaker comprising:

a screen frame having an outer perimeter and a first plurality of ribs extending in a first direction between opposing regions of the perimeter, the plurality of ribs defining an upper horizontal face; and a second plurality of ribs integrally formed with the screen frame and disposed substantially parallel to each other and substantially perpendicular to the first plurality of ribs, wherein the second plurality of ribs extends downwardly from the upper horizontal face at an angle offset to vertical wherein the angle of the second plurality of ribs is substantially aligned with the direction of vibration.

* * * * *